US012611005B2

(12) United States Patent
Case et al.

(10) Patent No.: US 12,611,005 B2
(45) **Date of Patent: *Apr. 28, 2026**

(54) CUSHIONING COMPONENT FOR A WEARABLE ARTICLE

(71) Applicant: NIKE, Inc., Beaverton, OR (US)

(72) Inventors: Patrick R. Case, Beaverton, OR (US); Scott C. Holt, Portland, OR (US); Dervin A. James, Hillsboro, OR (US); Kevin C. Sze, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/888,254

(22) Filed: Sep. 18, 2024

(65) Prior Publication Data

US 2025/0194740 A1 Jun. 19, 2025

Related U.S. Application Data

(60) Provisional application No. 63/610,447, filed on Dec. 15, 2023.

(51) Int. Cl.
*A43B 13/18* (2006.01)
*A43B 13/20* (2006.01)

(52) U.S. Cl.
CPC ..... *A43B 13/186* (2013.01); *A43B 13/20* (2013.01)

(58) Field of Classification Search
CPC ..... A43B 13/186; A43B 13/20; A43B 13/125; A43B 13/181
See application file for complete search history.

(56) References Cited

U.S. PATENT DOCUMENTS 2,968,105 A * 1/1961 Rizzo ..... A43B 13/20 36/77 R
4,183,156 A 1/1980 Rudy
4,219,945 A * 9/1980 Rudy ..... A43B 13/203 36/44

(Continued)

FOREIGN PATENT DOCUMENTS

CN 115153151 A 10/2022
TW 200601993 A 1/2006

(Continued)

*Primary Examiner* — Bao-Thieu L Nguyen
(74) *Attorney, Agent, or Firm* — Shook, Hardy & Bacon L.L.P.

(57) ABSTRACT

An article of footwear includes a sole structure having a cushioning component. The cushioning component includes a bladder defining an interior cavity between opposing inner surfaces of a first barrier sheet and a second barrier sheet, and the barrier sheets sealed to one another along a peripheral bond. A core is disposed in the interior cavity and spaced entirely inward of the peripheral bond. The core includes at least one polymeric sheet traversing the interior cavity between and directly bonded to the opposing inner surfaces of the barrier sheets at a plurality of wavy bonds to tether the barrier sheets to one another. The wavy bonds are arranged with waves having peaks and valleys extending in a fore-aft direction such that the at least one polymeric sheet does not create any sealed chambers within the bladder that are not in fluid communication with the interior cavity.

17 Claims, 7 Drawing Sheets

(56) References Cited

U.S. PATENT DOCUMENTS 4,774,774 A * 10/1988 Allen, Jr. ..... A43B 13/20 36/28
4,936,029 A 6/1990 Rudy
5,042,176 A 8/1991 Rudy
5,337,492 A * 8/1994 Anderie ..... A43B 13/181 36/114
5,713,141 A 2/1998 Mitchell et al.
5,755,001 A 5/1998 Potter et al.
5,930,918 A * 8/1999 Healy ..... A43B 13/20 36/35 B
5,952,065 A 9/1999 Mitchell et al.
6,013,340 A 1/2000 Bonk et al.
6,082,025 A 7/2000 Bonk et al.
6,127,026 A 10/2000 Bonk et al.
6,203,868 B1 3/2001 Bonk et al.
6,321,465 B1 11/2001 Bonk et al.
8,479,412 B2 7/2013 Peyton et al.
10,362,833 B2 7/2019 Campos, II et al.
10,694,814 B2 * 6/2020 Bailey ..... B32B 7/05
11,213,094 B2 1/2022 Case et al.
11,219,271 B2 1/2022 Auyang et al.
2002/0139471 A1 10/2002 Tawney et al.
2010/0107445 A1 * 5/2010 Aveni ..... A43B 13/189 36/35 B
2011/0277347 A1 11/2011 Monfils et al.
2012/0174432 A1 * 7/2012 Peyton ..... A43B 13/20 36/31
2012/0260524 A1 * 10/2012 Izquieta Anaut .... A43B 13/181 12/146 B
2013/0276329 A1 * 10/2013 James ..... A43B 17/026 36/83
2014/0053427 A1 2/2014 Patton
2014/0115925 A1 * 5/2014 Hurd ..... A43B 13/125 156/182
2015/0013190 A1 * 1/2015 Davison ..... A43B 13/186 36/102
2015/0113829 A1 * 4/2015 Kodad ..... A43B 13/141 383/105
2017/0042286 A1 * 2/2017 Meschter ..... A43B 13/189
2018/0213886 A1 * 8/2018 Connell ..... A43B 13/184
2018/0332925 A1 * 11/2018 Bailey ..... B32B 27/08
2018/0338577 A1 11/2018 Elder et al.
2018/0338578 A1 11/2018 Elder et al.
2019/0062614 A1 * 2/2019 Steinbeck ..... C09K 5/063
2019/0365036 A1 * 12/2019 Meeker ..... A43B 3/0052
2020/0154826 A1 5/2020 Case et al.
2020/0375307 A1 * 12/2020 Hurd ..... A43B 7/1485
2021/0353001 A1 * 11/2021 Elder ..... A43B 13/127
2021/0368920 A1 12/2021 Elder et al.
2021/0368921 A1 * 12/2021 Campos, II ..... A43B 7/144
2021/0368923 A1 * 12/2021 Seid ..... A43B 13/187
2022/0202137 A1 * 6/2022 Kiss ..... A43B 13/20
2024/0206591 A1 * 6/2024 Case ..... A43B 13/125
2025/0194744 A1 * 6/2025 Case ..... A43B 13/20

FOREIGN PATENT DOCUMENTS

TW 202027639 A 8/2020
TW 202126208 A 7/2021
WO 0170060 A2 9/2001

* cited by examiner

CUSHIONING COMPONENT FOR A WEARABLE ARTICLE

CROSS-REFERENCE TO RELATED APPLICATION

This application claims the benefit of priority to U.S. Provisional Application No. 63/610,447, filed Dec. 15, 2023 which is incorporated by reference in its entirety.

TECHNICAL FIELD

The present disclosure generally relates to a cushioning component for a wearable article that includes a bladder and a core of at least one polymeric sheet disposed in the bladder.

BACKGROUND

Wearable articles, such as articles of footwear, often include cushioning components. Some cushioning components are configured as fluid-filled bladders that enclose an interior cavity to retain a gas in the interior cavity, providing cushioning when loaded.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 3:
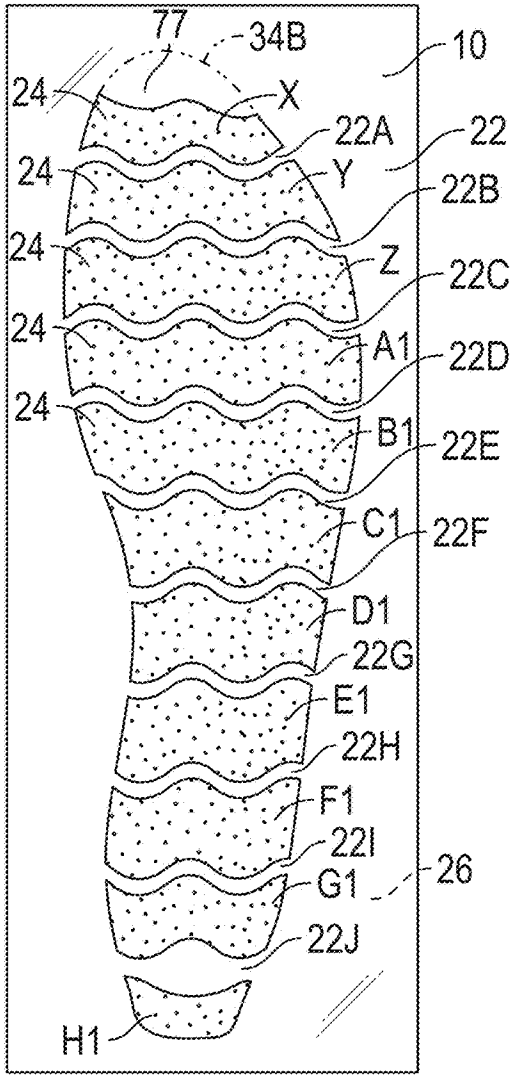
FIG. 3 is a plan view of a top side of another polymeric sheet with anti-weld material disposed thereon and with an opposite second side not having any anti-weld material disposed thereon.

The present disclosure generally relates to an article of footwear that includes a sole structure that has a cushioning component. The cushioning component includes a bladder and a core disposed in the bladder and bonded to inner sides of barrier sheets of the bladder to act as a tensile component. Providing a tensile component within a bladder may be useful in restraining the bladder when inflated, preventing it from adopting a ball-like shape. A tensile component such as the core according to the present disclosure enables bonding the at least one polymeric sheet of the core to the barrier sheets at bonds having patterns that result in technical advantages both in performance aspects of the cushioning component and ease of manufacturing the cushioning component.

More specifically, the bladder includes a first barrier sheet and a second barrier sheet. The first barrier sheet and the second barrier sheet together define an interior cavity between opposing inner surfaces of the first barrier sheet and the second barrier sheet. The first barrier sheet and the second barrier sheet are sealed to one another along a peripheral bond to enclose the interior cavity and retain a gas in the interior cavity. The core is disposed in the interior cavity and is spaced entirely inward of the peripheral bond. The core includes at least one polymeric sheet traversing the interior cavity between and directly bonded to the opposing inner surfaces of the first barrier sheet and the second barrier sheet at a plurality of wavy bonds to tether the first barrier sheet to the second barrier sheet. The at least one polymeric sheet of the core is displaced from the opposing inner surfaces by the gas at unbonded areas of the at least one polymeric sheet. The plurality of wavy bonds are arranged with waves having peaks and valleys extending in a fore-aft direction of the article of footwear and such that the gas in the interior cavity is in fluid communication around the at least one polymeric sheet of the core without the at least one polymeric sheet creating any sealed chambers within the bladder that are not in fluid communication with the interior cavity. In other words, the at least one polymeric sheet does not subdivide the interior cavity into separate, sealed chambers. By utilizing wavy bonds, the fore-aft extent of each bond is increased relative to a straight bond of the same width. This may increase the robustness of the bond and its ability to withstand repeated stresses, such as lateral forces, reducing the likelihood of delamination.

In an example, each bond of the plurality of wavy bonds extends continuously from a medial edge of the core to a lateral edge of the core.

In an implementation, anti-weld material is disposed on the core at the unbonded areas. By utilizing anti-weld material disposed on the at least one polymeric sheet, the patterns of bonds of the core to the inner surfaces of the barrier sheets (and the bonds of adjacent polymeric sheets in embodiments in which the core includes more than one polymeric sheet) are controlled to determine the final geometry of the completed cushioning component, including height differentials in different regions of an article of footwear, toe spring, etc.

Moreover, utilizing anti-weld material enables ease in manufacturing. For example, when the anti-weld material is blocker ink, patterns may be digitally implemented relatively easily in comparison to other tensile components that require specific molds or mold inserts to control bond formation of barrier sheets to internally placed polymeric sheets. By depositing the anti-weld material so that it extends to an outer perimeter of the core at the inner surfaces of the barrier sheets, and by ensuring that the outer perimeter of the core is entirely inward of the peripheral bond of the barrier sheets, the patterns of bonds of the core do not result in any sealed chambers within the bladder that are not in fluid communication with the interior cavity. In this way, the core itself controls the final geometry of the inflated cushioning component but does not affect the cushioning response of the cushioning component under dynamic loading. Additionally, by utilizing anti-weld material, the cushioning component may be relatively flat prior to inflation. Stated differently, the core may lay flat within the bladder with the unbonded areas contacting the opposing inner surfaces when the interior cavity of the bladder is uninflated.

In an example, a thickness of each polymeric sheet of the at least one polymeric sheet of the core is not greater than (e.g., is less than or equal to) a thickness of the first barrier sheet and is not greater than a thickness of the second barrier sheet.

In an implementation, the plurality of wavy bonds includes a first group of bonds in a forefoot region of the article of footwear and a second group of bonds in a heel region of the article of footwear. Spacing between adjacent bonds of the first group of bonds is less than spacing between adjacent bonds of the second group of bonds such that the opposing inner surfaces are held closer to one another by the at least one polymeric sheet in the forefoot region than in the heel region.

In an example, an outer perimeter of the at least one polymeric sheet is spaced further inward of the peripheral bond in a heel region of the article of footwear than in a forefoot region of the article of footwear.

In an example, the opposing inner surfaces of the bladder include a first inner surface of the first barrier sheet and a second inner surface of the second barrier sheet and the core is a multi-sheet core, the at least one polymeric sheet of the core including a first polymeric sheet and a second polymeric sheet. The first polymeric sheet may be disposed between the first barrier sheet and the second polymeric sheet, and the second polymeric sheet may be disposed between the first polymeric sheet and the second barrier sheet such that a first side of the first polymeric sheet faces the first inner surface of the first barrier sheet, a second side of the first polymeric sheet faces a first side of the second polymeric sheet, and a second side of the second polymeric sheet faces the second inner surface of the second barrier sheet. The first side of the first polymeric sheet may be directly bonded to the first inner surface of the first barrier sheet at a first set of bonds of the plurality of wavy bonds, the second side of the second polymeric sheet may be directly bonded to the second inner surface of the second barrier sheet at a second set of bonds of the plurality of wavy bonds, the second side of the first polymeric sheet may be directly bonded to the first side of the second polymeric sheet at a third set of bonds of the plurality of wavy bonds, the bonds of the third set alternating with the bonds of the first set along a length of the first polymeric sheet, and the bonds of the third set alternating with the bonds of the second set along a length of the second polymeric sheet.

In some implementations, at least some of the bonds of the second set may be aligned with the at least some of the bonds of the first set in the fore-aft direction of the article of footwear when the interior cavity of the bladder is uninflated. For example, at least some of the bonds of the second set may be wider in the fore-aft direction of the article of footwear than the bonds of the first set with which the at least some of the bonds of the second set are aligned. The bonds of the second set that are wider than the bonds of the first set may be in a forefoot region or in a heel region of the article of footwear.

As used herein, bonds are aligned with one another in a fore-aft direction of the article of footwear when a vertical plane perpendicular to a longitudinal axis of the article of footwear intersects the bonds. Accordingly, only a portion of a bond needs to be stacked over another bond in order for the two bonds to be considered aligned. As used herein, wider in the fore-aft direction of the article of footwear may also be referred to as longer, and narrower in the fore-aft direction of the article of footwear may also be referred to as shorter. As used herein, the fore-aft direction of the article of footwear is also the fore-aft direction of the cushioning component, and the longitudinal axis of the article of footwear is also the longitudinal axis of the cushioning component.

By providing wider bonds that will be disposed closer to the ground surface when the cushioning component is incorporated into an article of footwear, when inflated, the side with the narrower (e.g., shorter) bonds (e.g., the foot-facing side of the cushioning component) will allow for more pillowing between the bonds of the first set than between the bonds of the second set when inflated. The side with more pillowing (the foot-facing side) will contract more in overall length as the path of the material of the barrier sheet at the foot-facing side (e.g., the footbed side) is distributed vertically and horizontally. Accordingly, the foot-facing side with narrower bonds will become more concave after inflation. Providing the narrower bonds of the first set on the footbed side and the wider bonds on the ground-facing side thus helps to shape the inflated cushioning component to promote toe spring.

In some implementations, all of the bonds of the second set are aligned with the bonds of the first set in the fore-aft direction, and each bond of the second set is wider in the fore-aft direction than the respective bond of the first set with which the bond of the second set is aligned.

In some implementations, the bonds of the third set are offset in the fore-aft direction from the bonds of the second set and from the bonds of the first set, and each bond of the second set is wider in the fore-aft direction than adjacent bonds of the third set. Furthermore, each bond of the third set may be not narrower than adjacent bonds of the first set (e.g., may have a width greater than or equal to a width of adjacent bonds of the first set).

An article of footwear within the scope of the disclosure includes a sole structure that has a cushioning component. The cushioning component includes a bladder and a core. The bladder includes a first barrier sheet having a first inner surface and a second barrier sheet having a second inner surface opposing the first inner surface. The second barrier sheet is disposed distally of the first barrier sheet, the first barrier sheet and the second barrier sheet define an interior cavity between the first inner surface and the second inner surface, and the first barrier sheet and the second barrier sheet are sealed to one another along a peripheral bond to enclose the interior cavity and retain a gas in the interior cavity. The core is disposed in the interior cavity and spaced entirely inward of the peripheral bond. The core includes at least one polymeric sheet traversing the interior cavity between and directly bonded to the first inner surface at a first set of bonds and to the second inner surface at a second set of bonds to tether the first barrier sheet to the second barrier sheet. At least some of the bonds of the second set are wider in a fore-aft direction of the article of footwear than at least some of the bonds of the first set. The at least one polymeric sheet of the core is displaced from the first inner surface and the second inner surface of the barrier sheets by the gas at unbonded areas of the at least one polymeric sheet. The first set of bonds and the second set of bonds are arranged such that the gas in the interior cavity is in fluid communication around the at least one polymeric sheet of the core without the at least one polymeric sheet creating any sealed chambers within the bladder that are not in fluid communication with the interior cavity.

In an example, each bond of the first set and each bond of the second set extends continuously from a medial edge of the core to a lateral edge of the core.

The at least some of the bonds of the second set that are wider in the fore-aft direction of the article of footwear than at least some of the bonds of the first set may be in a forefoot region and/or in a heel region of the article of footwear in some implementations.

In some implementations, the bonds of the second set that are wider in the fore-aft direction of the article of footwear than at least some of the bonds of the first set may progressively decrease in width from a heel region to a forefoot region of the article of footwear.

In an example, the at least some of the bonds of the second set that are wider in the fore-aft direction than the at least some of the bonds of the first set may be aligned with the at least some of the bonds of the first set in the fore-aft direction when the interior cavity of the bladder is uninflated.

The above features and advantages and other features and advantages of the present teachings are readily apparent from the following detailed description of the modes for carrying out the present teachings when taken in connection with the accompanying drawings. It should be understood that even though in the following Figures embodiments may be separately described, single features thereof may be combined to additional embodiments.

Figure 2:
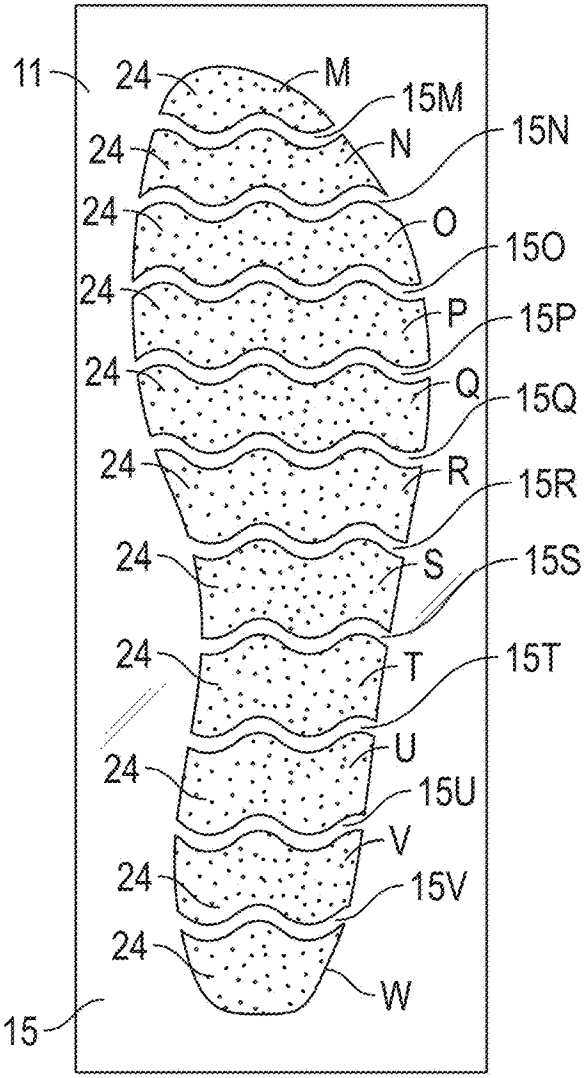
FIG. 2 is a plan view of an opposing top side of the polymeric sheet of FIG. 1 with anti-weld material disposed thereon in a different pattern than on the side shown in FIG. 1.
Figure 1:
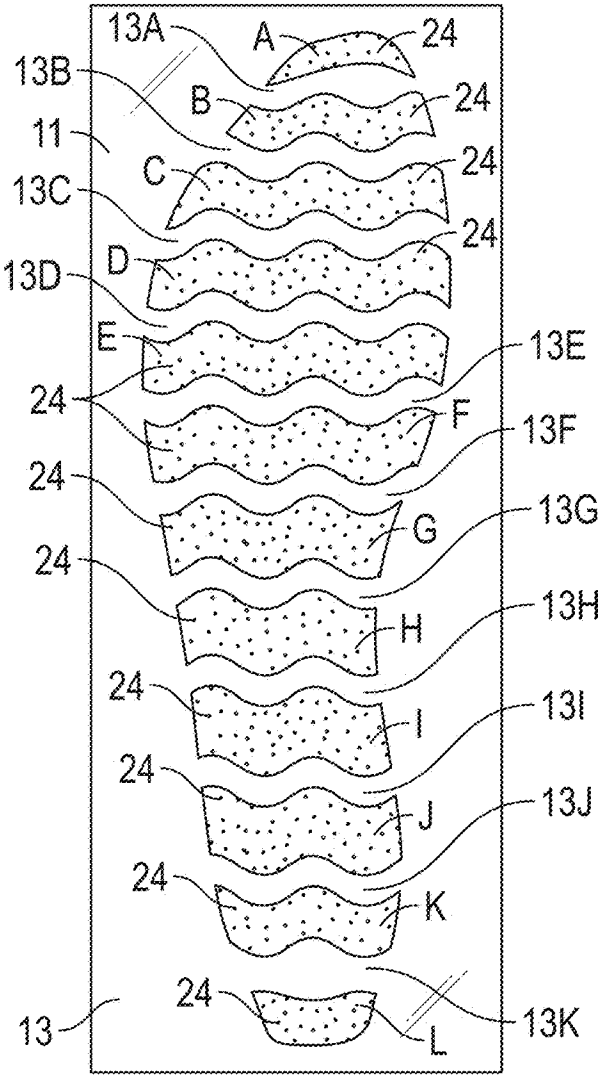
FIG. 1 is a plan view of a bottom side of a polymeric sheet with anti-weld material disposed thereon.
Figure 6:
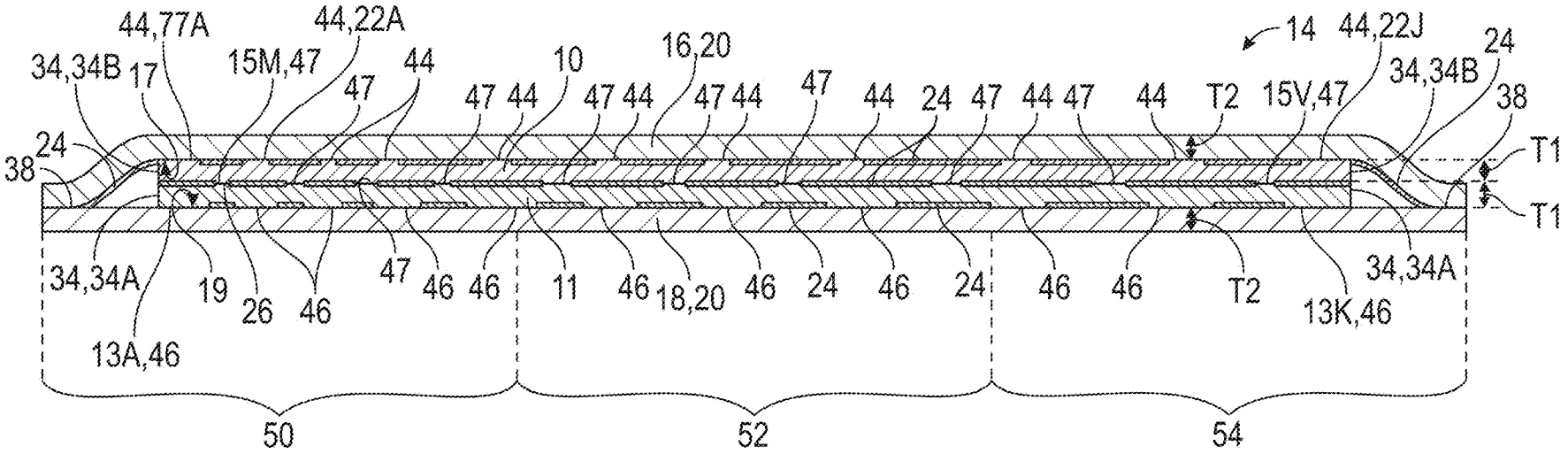
FIG. 6 is a cross-sectional view of a cushioning component including the core of FIG. 5 at a cross-section taken at lines 6-6 in FIG. 7 along a longitudinal axis and including a bladder having first and second barrier sheets, with the cushioning component in an uninflated state.

FIGS. 1-3 show polymeric sheets 10 and 11 used to form a core 12 shown in FIG. 6. The core 12 is included in a cushioning component 14 shown in FIGS. 6-9. More specifically, the cushioning component 14 is included in a sole structure 70 of an article of footwear 72 as shown in FIG. 9. As further explained herein, the cushioning component 14 includes a bladder 20 and the core 12 is disposed in the bladder 20 and bonded to inner surfaces 17, 19 of barrier sheets 16, 18 of the bladder 20 to act as a tensile component. Providing a tensile component within a bladder may be useful in restraining the bladder when inflated, preventing it from adopting a ball-like shape. A tensile component such as the core 12 according to the present disclosure enables bonding the polymeric sheets 10, 11 to the barrier sheets 16, 18 at bonds having patterns that result in technical advantages both in performance aspects of the cushioning component 14 and ease of manufacturing the cushioning component 14.

FIG. 1 is a plan view of a bottom side of the polymeric sheet 11 with anti-weld material 24 disposed thereon. The polymeric sheet 11 is referred to herein as a second polymeric sheet. The side of the polymeric sheet shown in FIG. 1 is a second side 13 and is also referred to as a bottom side or distal side as it is disposed further from the foot when the core 12 is incorporated in the sole structure 70 of the article of footwear 72. The second side 13 interfaces with and is bonded to the inner surface 19 of the second barrier sheet 18 as shown in FIG. 6 and discussed herein.

FIG. 2 is a plan view of an opposing first side 15 of the second polymeric sheet 11 with anti-weld material 24 disposed thereon in a different pattern than on the second side 13 shown in FIG. 1. The first side 15 is also referred to as the top side or as the proximal side of the second polymeric sheet 11 as it is disposed closer to the foot when the core 12 is incorporated in the sole structure 70 of the article of footwear 72.

As best shown in FIGS. 4-9, each of the core 12, the cushioning component 14, and the article of footwear 72 includes a forefoot region, a heel region, and a midfoot region. These regions are referred to as a forefoot region 50, a midfoot region 52, and a heel region 54 with respect to the cushioning component 14, the sole structure 70, and the article of footwear 72. However, because the core 12 is of a shorter length than each of the cushioning component 14, the sole structure 70, and article of footwear 72, the forefoot region, midfoot region, and heel region of the core 12 are referred to as 50A, 52A, and 54A, respectively. The forefoot region 50 and 50A generally includes portions of the article of footwear 72 or the core 12 corresponding with the toes and the joints connecting the metatarsals with the phalanges of a wearer's foot. The midfoot region 52 and 52A generally includes portions of the article of footwear 72 or the core 12 corresponding with the arch area of the foot, and the heel region 54 and 54A corresponds with rear portions of the foot, including the calcaneus bone. Each of the core 12, the cushioning component 14, the sole structure 70, and the article of footwear 72 include a medial side 80 and a lateral side 82 that extend through each of forefoot region 50 and 50A, the midfoot region 52 and 52A, and the heel region 54 and 54A and fall on opposite sides of a longitudinal midline (e.g., longitudinal axis LA) of the cushioning component 14 in FIG. 7. The forefoot region 50 and 50A, the midfoot region 52 and 52A, the heel region 54 and 54A, the medial side 80, and the lateral side 82 are not intended to demarcate precise areas of footwear 72, the core 12, the cushioning component 14, or the sole structure 70, but are instead intended to represent general areas of the article of footwear 72, the core 12, the cushioning component 14, and the sole structure 70 to aid in the following discussion.

FIG. 3 is a plan view of a first side 22 of the first polymeric sheet 10 with anti-weld material 24 disposed thereon. The opposite second side 26 does not have any anti-weld material disposed thereon. The first polymeric sheet 10 is stacked on the second polymeric sheet 11 when the core 12 is assembled such that the second side 26 interfaces with and is bonded to the first side 15 of the second polymeric sheet 11 and the first side 22 interfaces with and is bonded to the inner surface 17 of the first barrier sheet 16 as shown in FIG. 6 and discussed herein.

The anti-weld material 24 is disposed on the polymeric sheets 10, 11 of the core 12 at areas that will be unbonded areas when the core 12 is thermally processed. By utilizing anti-weld material 24 disposed on the polymeric sheets 10, 11, the patterns of bonds of the core 12 to the inner surfaces 17, 19 of the barrier sheets 16, 18 (and the bonds of the second side 26 of the first polymeric sheet 10 to the first side 15 of the second polymeric sheet 11) are controlled to determine the final geometry of the completed cushioning component 14, including height differentials in different regions (e.g., forefoot region 50 and heel region 54) of an article of footwear 72, toe spring, etc. As shown in FIG. 6, portions of one or both of the inner surfaces 17, 19 that are outward of the outer perimeter 34 of the core 12 and inward of where the peripheral bond 38 is formed may also be preprinted or otherwise prepared with anti-weld material 24 or otherwise processed so that these portions of the inner surfaces 17, 19 will not bond to one another.

The anti-weld material 24 may be disposed on the polymeric sheets 10 and 11 (and on the portions of the inner surfaces 17, 19 of the first barrier sheet 16 and/or second barrier sheet 18 shown in FIG. 6) via a computer-controlled printer head or heads (not shown) according to a stored algorithm representing a predetermined printing pattern. As used herein, the anti-weld material 24 may be blocker ink, and may also be referred to as anti-weld ink. For example, when the anti-weld material is blocker ink, it may be printed according to a different predetermined programmed pattern for the first side 22 of the first polymeric sheet 10, the first side 15 of the second polymeric sheet 11 and the second side 13 of the second polymeric sheet 11 at all selected locations where bonds of the polymeric sheets 10, 11 of the core 12 to one another or to the barrier sheets 16, 18 are not desired. After trimming the sheets 10, 11 to establish the outer perimeters 34B, 34A and when bonded to one another such as by thermal processing, adjacent surfaces of the stacked, flat polymeric sheets 10, 11 and barrier sheets 16, 18 are bonded to one another except where the anti-weld material 24 is disposed. Accordingly, the patterns of anti-weld material 24 determine corresponding patterns of resulting bonds in the finished cushioning component 14.

The predetermined pattern of anti-weld material 24 on the second side 13 of the second polymeric sheet 11 in FIG. 1 is referred to as a second predetermined pattern and results in a second set of bonds 46 discussed with respect to FIGS. 4 and 6-9. The predetermined pattern of anti-weld material 24 on the first side 15 of the second polymeric sheet 11 in FIG. 2 is referred to as a third predetermined pattern and results in a third set of bonds 47 discussed with respect to FIGS. 4-9. The predetermined pattern of anti-weld material 24 on the first side 22 of the first polymeric sheet 10 is referred to as a first predetermined pattern and results in a first set of bonds 44 discussed with respect to FIGS. 5-9.

With reference to FIG. 1, the anti-weld material 24 is disposed on the second side 13 of the second polymeric sheet 11 in the second predetermined pattern at spaced regions A, B, C, D, E, F, G, H, I, J, K, and L of deposited anti-weld material 24. Areas of the second side 13 of the second polymeric sheet 11 between any adjacent two of the spaced regions A, B, C, D, E, F, G, H, I, J, K, and L are free from anti-weld material 24. More specifically, area 13A between adjacent regions A and B is free from anti-weld material 24, area 13B between adjacent spaced regions B and C is free from anti-weld material 24, area 13C between adjacent spaced regions C and D is free from anti-weld material 24, area 13D between adjacent spaced regions D and E is free from anti-weld material 24, area 13E between adjacent spaced regions E and F is free from anti-weld material 24, area 13F between adjacent spaced regions F and G is free from anti-weld material 24, area 13G between adjacent spaced regions G and H is free from anti-weld material 24, area 13H between adjacent spaced regions H and I is free from anti-weld material 24, area 13I between adjacent spaced regions I and J is free from anti-weld material 24, area 13J between adjacent spaced regions J and K is free from anti-weld material 24, and area 13K between adjacent spaced regions K and L is free from anti-weld material 24. The areas 13A, 13B, 13C, 13D, 13E, 13F, 13G, 13H, 13I, 13J, and 13K will become a second set of bonds 46 shown in FIG. 6, each corresponding with one of the areas 13A-13K. The areas 13A and 13K are indicated in FIG. 6 and the remaining areas at bonds 46 are not numbered in FIG. 6 for clarity in the drawing but correspond with areas 13B-13J in order from area 13A to area 13K.

Figure 7:
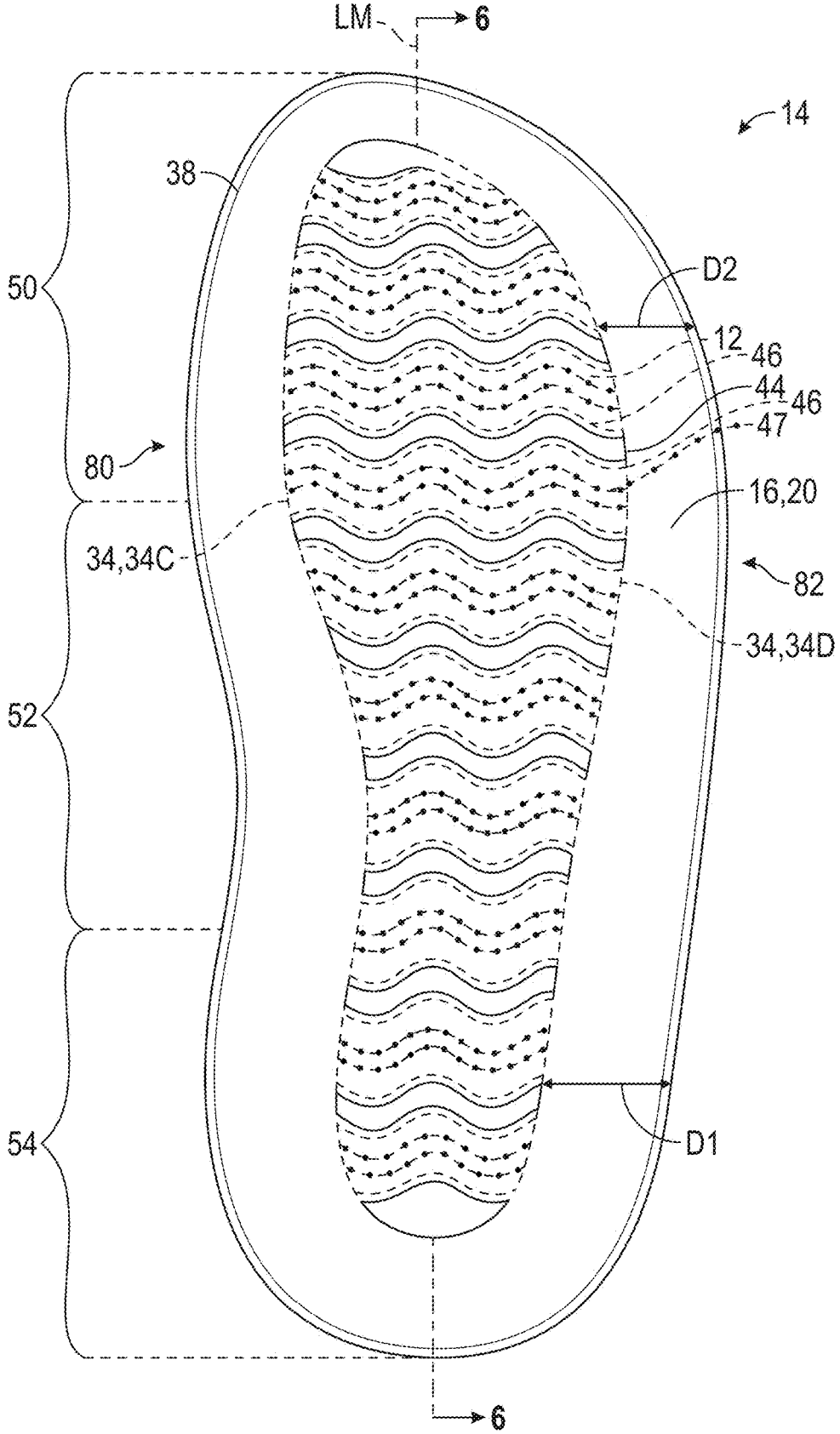
FIG. 7 is a plan view of the cushioning component of FIG. 6 in an uninflated state.

Each of the areas 13A-13K has a wavy shape such that the second set of bonds 46 are wavy bonds as further described with respect to FIG. 7. The second polymeric sheet 11 is trimmed to an outer perimeter 34A shown in FIGS. 4 and 6 after printing the anti-weld material 24 such that the areas A-L of anti-weld material 24 extend to the perimeter 34A and the areas 13A-13K and corresponding resulting bonds 46 also extend to the perimeter 34A at both the medial and lateral sides 80, 82.

With reference to FIG. 2, the anti-weld material 24 is disposed on the first side 15 of the second polymeric sheet 11 in the third predetermined pattern at spaced regions M, N, O, P, Q, R, S, T, U, V, and W of deposited anti-weld material 24. Areas of the first side 15 of the second polymeric sheet 11 between any adjacent two of the spaced regions M, N, O, P, Q, R, S, T, U, V, and W are free from anti-weld material 24. More specifically, area 15M between adjacent regions M and N is free from anti-weld material 24, area 15N between adjacent spaced regions N and O is free from anti-weld material 24, area 15O between adjacent spaced regions O and P is free from anti-weld material 24, area 15P between adjacent spaced regions P and Q is free from anti-weld material 24, area 15Q between adjacent spaced regions Q and R is free from anti-weld material 24, area 15R between adjacent spaced regions R and S is free from anti-weld material 24, area 15S between adjacent spaced regions S and T is free from anti-weld material 24, area 15T between adjacent spaced regions T and U is free from anti-weld material 24, area 15U between adjacent spaced regions U and V is free from anti-weld material 24, and area 15V between adjacent spaced regions V and W is free from anti-weld material 24. The areas 15M, 15N, 15O, 15P, 15Q, 15R, 15S, 15T, 15U, and 15V will become a third set of bonds 47 shown in FIG. 6, each corresponding with one of the areas 15M-15V. The areas 15M and 15V are indicated in FIG. 6 and the remaining areas at bonds 47 are not numbered in FIG. 6 for clarity in the drawing but correspond with areas 15N-15U in order from area 15M to area 15V.

Each of the areas 15M-15V has a wavy shape such that the third set of bonds 47 are wavy bonds as further described with respect to FIGS. 4-5 and 7-8. The second polymeric sheet 11 is trimmed to an outer perimeter 34A shown in FIGS. 4 and 6 and after printing the anti-weld material 24 such that the areas M-W of anti-weld material 24 extend to the perimeter 34A and the areas 15M-15V and corresponding resulting bonds 47 also extend to the perimeter 34A.

With reference to FIG. 3, the anti-weld material 24 is disposed on the first side 22 of the first polymeric sheet 10 in the first predetermined pattern at spaced regions X, Y, Z, A1, B1, C1, D1, E1, F1, G1, and H1 of deposited anti-weld material 24. Areas of the first side 22 of the first polymeric sheet 10 between any adjacent two of the spaced regions X, Y, Z, A1, B1, C1, D1, E1, F1, G1, and H1 are free from anti-weld material 24. More specifically, area 22A between adjacent regions X and Y is free from anti-weld material 24, area 22B between adjacent spaced regions Y and Z is free from anti-weld material 24, area 22C between adjacent spaced regions Z and A1 is free from anti-weld material 24, area 22D between adjacent spaced regions A1 and B1 is free from anti-weld material 24, area 22E between adjacent spaced regions B1 and C1 is free from anti-weld material 24, area 22F between adjacent spaced regions C1 and D1 is free from anti-weld material 24, area 22G between adjacent spaced regions D1 and E1 is free from anti-weld material 24, area 22H between adjacent spaced regions E1 and F1 is free from anti-weld material 24, area 22I between adjacent spaced regions F1 and G1 is free from anti-weld material 24, and area 22J between adjacent spaced regions G1 and H1 is free from anti-weld material 24. The areas 22A, 22B, 22C, 22D, 22E, 22F, 22G, 22H, 22I, and 22J will become a first set of bonds 44 shown in FIG. 6, each corresponding with one of the areas X-H1. The areas 22A and 22J are indicated in FIG. 6 and the remaining areas at bonds 44 are not numbered in FIG. 6 for clarity in the drawing but correspond with areas 22B-22I in order from area 22A to area 22J. Area 77 shown on the polymeric sheet 10 in FIG. 3 just above the deposited anti-weld material 24 that will be part of the core 12 once the first polymeric sheet 10 is trimmed (see the outer perimeter 34B after trimming represented in phantom at the top of the first predetermined pattern in FIG. 3) will become a foremost bond 77A of the first polymeric sheet 10 to the first barrier sheet 16 after trimming the polymeric sheet 10 to the outer perimeter 34B and then thermally processing the cushioning component 14.

Each of the areas 22A-22J has a wavy shape such that the first set of bonds 44 are wavy bonds as further described with respect to FIG. 7. The first polymeric sheet 10 is trimmed to an outer perimeter 34B shown in FIGS. 5 and 6 and after printing the anti-weld material 24 such that the areas X-H1 of anti-weld material 24 extend to the outer perimeter 34B and the areas 22A-22J and corresponding resulting bonds 44 also extend to the outer perimeter 34B.

Figure 4:
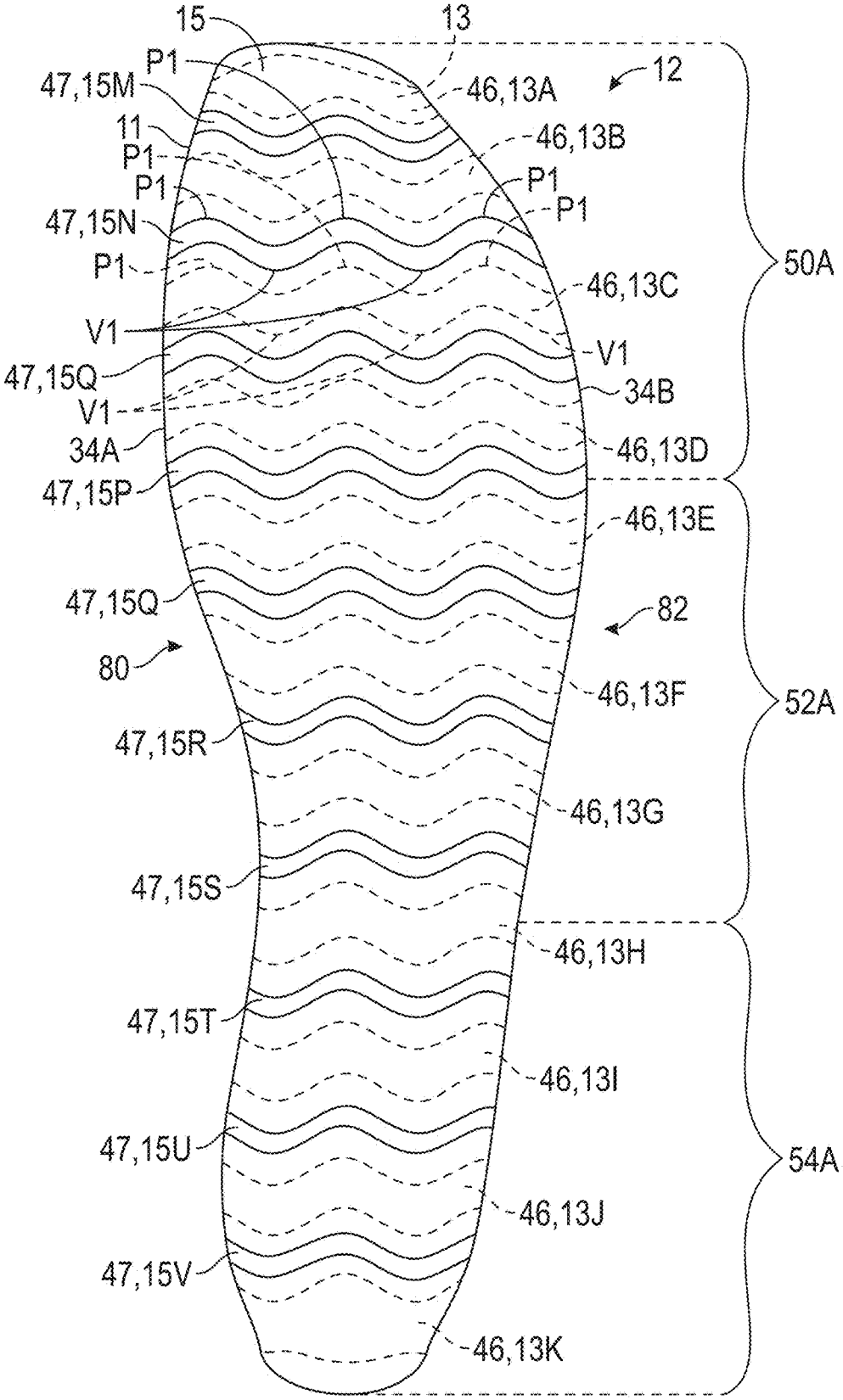
FIG. 4 is a plan view of a portion of a core formed from the polymeric sheets of FIGS. 1-3, showing the polymeric sheet of FIGS. 1-2 as a lower core sheet and representing bonded areas at the top side of the polymeric sheet of FIG. 2 in solid and bonded areas at the bottom side of the polymeric sheet of FIG. 2 in dashed lines.

FIG. 4 is a plan view of the top side of a portion of the core 12 formed from the polymeric sheets of FIGS. 1-3, not showing the first polymeric sheet 10 or the barrier sheets 16, 18 to which the core 12 is bonded, but showing only the second polymeric sheet 11 as the lower core sheet when the core 12 is assembled in order to illustrate the relative locations of the third set of bonds 47 and the second set of bonds 46. The bonded areas at the top side (first side 15) are the third set of bonds 46 where the first side 15 of the second polymeric sheet 11 of the core 12 bonds to the bottom side (second side 26) of the first polymeric sheet 10 (not shown in FIG. 4) and are represented in solid, and the bonded areas at the opposite bottom side 13 (second side) of the second polymeric sheet 11 are represented with dashed lines and are the second set of bonds 46 wherein the second side 13 of the second polymeric sheet 11 is bonded to the inner surface 19 of the second barrier sheet 18. The areas 15M-15V corresponding with each of the third set of bonds 47 and the areas 13A-13K corresponding with each of the second set of bonds 46 are also indicated with reference numbers. FIG. 4 shows that the bonds 47 of the third set of bonds are offset from the bonds 46 of the second set of bonds in the longitudinal direction of the core 12 (e.g., from a forefoot region 50A of the core 12 to a heel region 54A of the core 12). Stated differently, each bond 47 of the third set of bonds is disposed between two adjacent bonds 46 of the second set of bonds without overlapping with the second set of bonds 46. In this manner, the second polymeric sheet 11 will extend in the vertical direction as shown in FIG. 9 between adjacent bonds 46 and 47 when the internal cavity 21 of the bladder 20 is inflated, tethering the second barrier sheet 18 to the first polymeric sheet 10.

FIG. 4 also illustrates that the bonds 46 of the second set of bonds and the bonds 47 of the third set of bonds are wavy bonds. Stated differently, each of the bonds 46 and each of the bonds 47 has waves having peaks P1 and valleys V1 extending in a fore-aft direction when the core 12 is disposed in the article of footwear 72. For example, bond 47 at area 15N is illustrated having three peaks P1 and two valleys V1. Adjacent bond 46 at area 13C also has three peaks P1 and three valleys V1. Some of the bonds 46, 47 have partial peaks or partial valleys near the perimeter 34A. The peaks and valleys of the other bonds 46 and 47 are not labeled for clarity in the drawings. The number of peaks P1 and valleys V1 of each bond 46 and each bond 47 depends upon the width of the core 12 at the particular bond as spacing between peaks P1 and valleys V1 of each of the bonds 46 and 47 is maintained as relatively equal. By utilizing wavy bonds, the fore-aft extent of each bond (e.g., the longitudinal distance between a peak P1 and a valley V1 of the bond) is increased relative to a straight bond of the same width. This may increase the robustness of the bond and its ability to withstand repeated stresses, such as lateral forces, reducing the likelihood of delamination.

Figure 5:
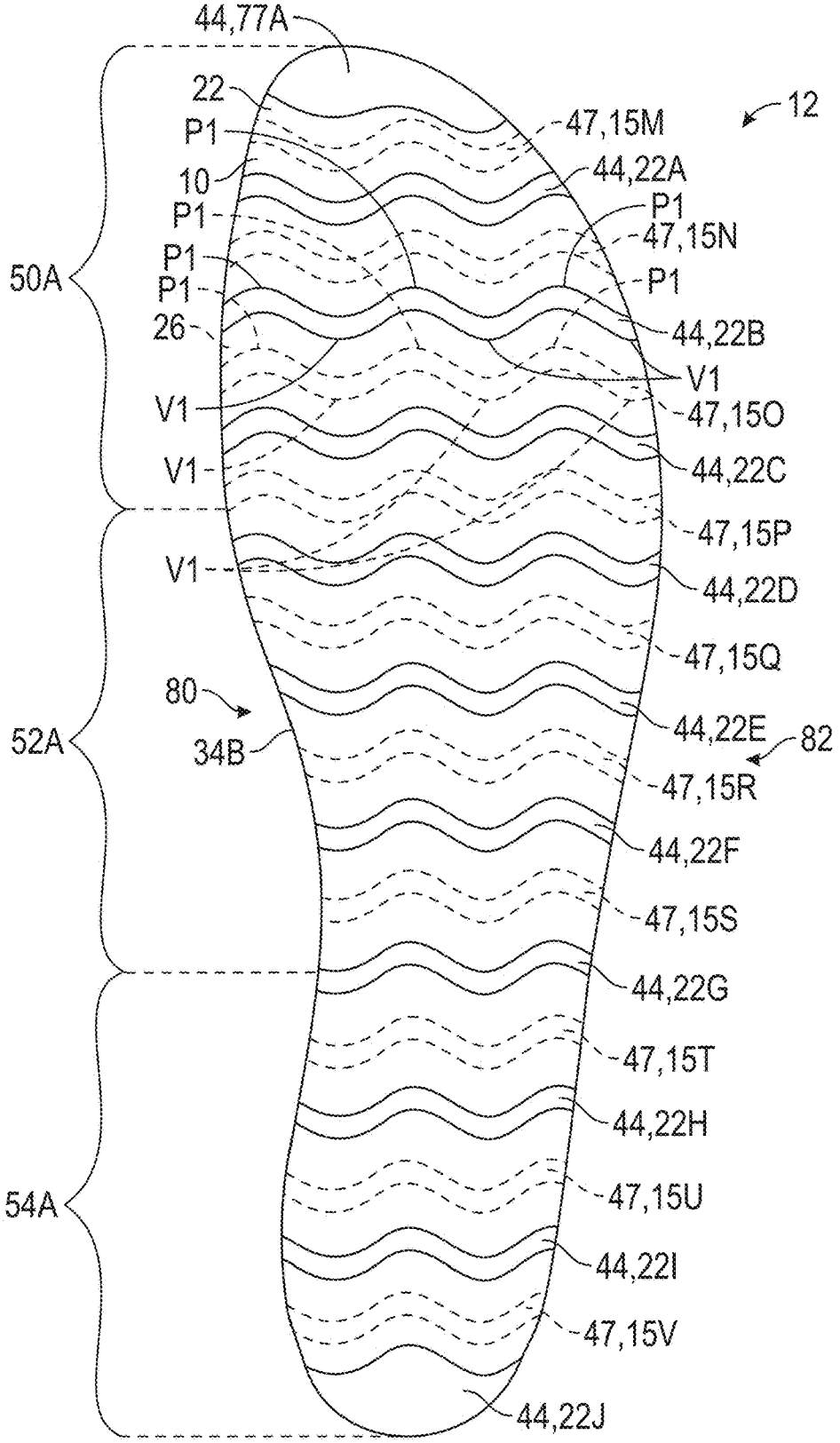
FIG. 5 is a plan view of a portion of the core formed from the polymeric sheets of FIGS. 1-3 showing the polymeric sheet of FIG. 3 as an upper core sheet and representing bonded areas at the top side of the upper core sheet in solid and bonded areas at the bottom side of the upper core sheet in dashed lines.

FIG. 5 is a plan view of a portion of the core 12 showing only the polymeric sheet 10 of FIG. 3 as an upper core sheet and representing bonded areas at the top side 22 of the polymeric sheet 10 in solid and bonded areas at the bottom side 26 of the polymeric sheet 10 in dashed lines in order to illustrate the relative locations of the third set of bonds 47 and the first set of bonds 44. The bonded areas at the top side (first side 22) are the first set of bonds 44 where the first side 22 of the first polymeric sheet 10 of the core 12 bonds to the inner surface 17 of the first barrier sheet 16. The bonded areas at the opposite bottom side 26 (second side) of the first polymeric sheet 10 are represented with dashed lines and are the third set of bonds 47 wherein the second side 26 of the first polymeric sheet 10 is bonded to the first side 15 of the second polymeric sheet 11. The areas 15M-15V corresponding with each of the third set of bonds 47 and the areas 22A-22J corresponding with each of the first set of bonds 44 are also indicated with reference numbers. FIG. 5 shows that the bonds 47 of the third set of bonds are offset from the bonds 44 of the first set of bonds in the longitudinal direction of the core 12 (e.g., from a forefoot region 50A of the core 12 to a heel region 54A of the core 12). Stated differently, each bond 47 of the third set of bonds is disposed between two adjacent bonds 44 of the first set of bonds without overlapping with the first set of bonds 44. In this manner, the first polymeric sheet 10 will extend in the vertical direction as shown in FIG. 9 between adjacent bonds 44 and 47 when the internal cavity 21 of the bladder 20 is inflated, tethering the first barrier sheet 16 to the first polymeric sheet 10 and tethering the second polymeric sheet 11 to the first polymeric sheet 10.

FIG. 5 also illustrates that the bonds of the first set of bonds 44 and the bonds of the third set of bonds 47 are wavy bonds. Stated differently, each of the bonds 44 and each of the bonds 47 has waves having peaks P1 and valleys V1 extending in a fore-aft direction when the core is disposed in the article of footwear 72. For example, bond 44 at area 22B is illustrated having three peaks P1 and three valleys V1. Adjacent bond 47 at area 15O also has three peaks P1 and has three valleys V1. The peaks and valleys of the other bonds 44 and 47 are not labeled for clarity in the drawings. Some of the bonds 44, 47 have partial peaks or partial valleys near the outer perimeter 34B. The number of peaks P1 and valleys V1 of each bond 44 and each bond 47 depends upon the width of the core 12 at the particular bond as spacing between peaks P1 and valleys V1 of each of the bonds 44 and 47 is maintained as relatively equal.

Referring again to FIG. 6, after trimming the first polymeric sheet 10 and the second polymeric sheet 11 to establish the respective outer perimeters 34B, 34A, the first polymeric sheet 10 is stacked on the second polymeric sheet 11 with the second side 13 of the second polymeric sheet 11 adjacent to the inner surface 19 of the second barrier sheet 18 and the first side 22 of the first polymeric sheet 10 adjacent to the inner surface 17 of the first barrier sheet 16. The aligned outer perimeters 34B and 34A of the stacked polymeric sheets 10 and 11 establish and may together be referred to as an outer perimeter 34 of the core 12. In this relative positioning, the barrier sheets 16, 18 and the polymeric sheets 10, 11 are thermally processed to form the bonds 38, 44, 46, and 47 discussed herein. The first barrier sheet 16 and the second barrier sheet 18 together define the interior cavity 21 between the opposing inner surfaces 17, 19 of the first barrier sheet 16 and the second barrier sheet 18.

As shown in FIG. 6, the cushioning component 14 is relatively flat prior to inflation. Stated differently, the core 12 lays flat within the bladder 20 with the unbonded areas contacting the opposing inner surfaces 17, 19 when the interior cavity 21 of the bladder 20 is uninflated. The unbonded areas are as discussed with respect to FIGS. 1-5 and are where anti-weld material 24 is shown in FIG. 6. Only some of the areas with anti-weld material 24 are indicated with a reference number in FIG. 6 for clarity in the drawing.

Traditional tensile components may include a first polymeric sheet bonded only to the inner surface of the first barrier sheet, a second polymeric sheet bonded only to the inner surface of the second barrier sheet, and a plurality of tethers extending from the first polymeric sheet to the second polymeric sheet. Due to this configuration, such traditional tensile components are not relatively flat or sheet-like prior to inflating the interior cavity of a bladder in which they are disposed and are not amendable to heat pressing either to create a core of multiple polymeric sheets or to bond a core of a single polymeric sheet or multiple polymeric sheets to the inner surfaces of the barrier sheets.

As indicated in FIG. 6, the polymeric sheets 10 and 11 are each shown as having the same thickness T1. The barrier sheets 16 and 18 are each shown as having the same thickness T2. The thickness T1 is not greater than the thickness T2. Maintaining a sheet thickness of each polymeric sheet 10 and 11 not greater than that of each of the barrier sheets 16 and 18 helps to ensure the flexibility of the core 12 to function as a tether that collapses back toward the relatively flat state of FIG. 6 easily under compressive loading.

As shown in FIGS. 6-9, the first barrier sheet 16 and the second barrier sheet 18 are sealed to one another along the peripheral bond 38 to enclose the interior cavity 21 and retain a gas in the interior cavity. The barrier sheets 16, 18 of the bladder 20 can be formed from a variety of materials including various polymers that can resiliently retain a fluid such as air or another gas. The polymeric sheets 10 and 11 may be formed of the same material or materials as the barrier sheets 16, 18 as described herein, or may be formed of a polymeric material that does not necessarily retain fluid, as, unlike the barrier sheets 16, 18, the polymeric sheets 10 and 11 function as tethers but do not seal any interior cavity as do the barrier sheets 16, 18. Examples of polymeric materials for the barrier sheets 16, 18 and the polymeric sheets 10 and 11 can include thermoplastic urethane, polyurethane, polyester, polyester polyurethane, and polyether polyurethane. Moreover, the barrier sheets 16, 18 and the polymeric sheets 10 and 11 can be formed of layers of different materials. In one embodiment, the barrier sheets 16, 18 and/or the polymeric sheets 10 and 11 are formed from thin films having one or more thermoplastic polyurethane layers with one or more barrier layers of a copolymer of ethylene and vinyl alcohol (EVOH) that is impermeable to the pressurized fluid contained therein as disclosed in U.S. Pat. No. 6,082,025, which is incorporated by reference in its entirety. The barrier sheets 16, 18 and the polymeric sheets 10 and 11 may also be formed from a material that includes alternating layers of thermoplastic polyurethane and ethylene-vinyl alcohol copolymer, as disclosed in U.S. Pat. Nos. 5,713,141 and 5,952,065 to Mitchell et al. which are incorporated by reference in their entireties. Alternatively, the layers may include ethylene-vinyl alcohol copolymer, thermoplastic polyurethane, and a regrind material of the ethylene-vinyl alcohol copolymer and thermoplastic polyurethane. The barrier sheets 16, 18 and the polymeric sheets 10 and 11 may also each be a flexible microlayer membrane that includes alternating layers of a gas barrier material and an elastomeric material, as disclosed in U.S. Pat. Nos. 6,082,025 and 6,127,026 to Bonk et al. which are incorporated by reference in their entireties. Additional suitable materials for the barrier sheets 16, 18 and the polymeric sheets 10 and 11 are disclosed in U.S. Pat. Nos. 4,183,156 and 4,219,945 to Rudy which are incorporated by reference in their entireties. Further suitable materials for the barrier sheets 16, 18 and the polymeric sheets 10 and 11 include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340, 6,203,868, and 6,321,465 to Bonk et al. which are incorporated by reference in their entireties. In selecting materials for the barrier sheets 16, 18 and the polymeric sheet 10, engineering properties such as tensile strength, stretch properties, fatigue characteristics, dynamic modulus, and loss tangent can be considered. The thickness of the barrier sheets 16, 18 and the polymeric sheets 10 and 11 can be selected to provide these characteristics.

As shown in FIG. 7, each bond 44, 46, and 47 of the plurality of wavy bonds extends continuously from a medial edge 34C of the core to a lateral edge 34D of the core. The medial edge 34C is a portion of the perimeter 34 at a medial side 80 of the longitudinal axis LA. The longitudinal axis LA is also referred to herein as a longitudinal midline. The lateral edge 34D is a portion of the perimeter 34 at a lateral side 82 of the longitudinal axis LA. The medial side 80 and lateral side 82 also described the respective sides of the cushioning component 14 and the article of footwear 72 as well as its other components. By depositing the anti-weld material 24 so that it extends to an outer perimeter 34 of the core 12 at the inner surfaces 17, 19 of the barrier sheets 16, 18 and between the polymeric sheets 10, 11 (on the first side 15 of the second polymeric sheet 11), and by ensuring that the outer perimeter 34 of the core 12 is entirely inward of the peripheral bond 38 of the barrier sheets 16, 18 as shown in FIG. 7, for example, ensures that the resulting pattern of bonds 44, 46, and 47 of the core 12 does not result in any sealed chambers within the bladder 20 that are not in fluid communication with the interior cavity 21. In this way, the core 12 itself controls the final geometry of the inflated cushioning component 14 but does not affect the cushioning response of the cushioning component 14 under dynamic loading.

FIG. 7 illustrates the relative alignment of the sets of bonds 44, 46, and 47 afforded by the precise predetermined patterns of the anti-weld material 24 disposed on the first side 22 of the first polymeric sheet 10, on the second side 13 of the second polymeric sheet 11, and on the first side 15 of the second polymeric sheet 11, respectively. In FIG. 7, the bonds 44 of the first set are indicated with solid lines. The bonds 46 of the second set are indicated with dashed lines. The bonds 47 of the third set are indicated with a combination of dashed and dotted lines. It is clear from the FIG. 5 and FIG. 7 that the bonds 47 of the third set alternate with the bonds 44 of the first set along a length of the core 12 (e.g., along a length of the first polymeric sheet 10 of the core 12) and hence along a length of the resulting cushioning component 14. It is also clear from FIGS. 4 and 7 that the bonds 47 of the third set alternate with the bonds 46 of the second set along a length of the core 12 (e.g., along a length of the second polymeric sheet 11 of the core 12) and hence along a length of the resulting cushioning component 14. With this configuration, as best indicated in FIGS. 7 and 9, at least some of the bonds 46 of the second set are aligned with the at least some of the bonds 44 of the first set. More specifically, the bonds 44 of the first set are disposed vertically above the bonds 46 of the second set with a bond 47 of the third set offset from and vertically at a height between that of bond 44, 46 of each vertically-stacked set of bonds 44, 46.

Additionally, as best shown in FIGS. 7 and 9, at least some of the bonds 46 of the second set are wider in a fore-aft direction of the core 12, of the cushioning component 14, and of the article of footwear 72 than the bonds 44 of the first set with which the at least some of the bonds 46 of the second set are aligned. In the example shown, all of the bonds 46 of the second set are aligned with the bonds 44 of the first set, and each bond 46 of the second set is wider than the respective bond 44 of the first set with which the bond 46 of the second set is aligned. The bonds 46 of the second set that are wider than the bonds 44 of the first set are thus in both the forefoot region 50 and the heel region 54 as well as in the midfoot region 52 of the article of footwear 72. In other examples, the bonds 46 of the second set may be wider than the bonds 44 of the first set only in the forefoot region 50 or only in the heel region 54, for example.

By providing wider bonds 46 that are disposed closer to the ground surface GS when the cushioning component 14 is incorporated into the article of footwear 72 as shown in FIG. 9, when inflated, the side with the narrower (e.g., shorter) bonds (e.g., the second barrier sheet 18 at the foot-facing side of the cushioning component 14) will allow for more pillowing between the bonds 44 of the first set than between the bonds 46 of the second set when inflated. The side with more pillowing (e.g., the first barrier sheet 16 at the foot-facing side) will contract more in overall length as the path of the material of the barrier sheet 16 at the foot-facing side (e.g., the footbed side) is distributed vertically and horizontally. Accordingly, the first barrier sheet 16 at the foot-facing side with narrower bonds 44 will become more concave after inflation than the second barrier sheet 18 with the wider bonds 46 and may cause the overall shape of the cushioning component 14 to curve upwards at the forefoot region 50 and at the heel region 54 at the ground-facing side (e.g., at the second barrier sheet 18). Providing the narrower bonds 44 of the first set on the footbed side and the wider bonds 46 of the second set on the ground-facing side thus helps to shape the inflated cushioning component 14 to promote toe spring.

Figure 8:
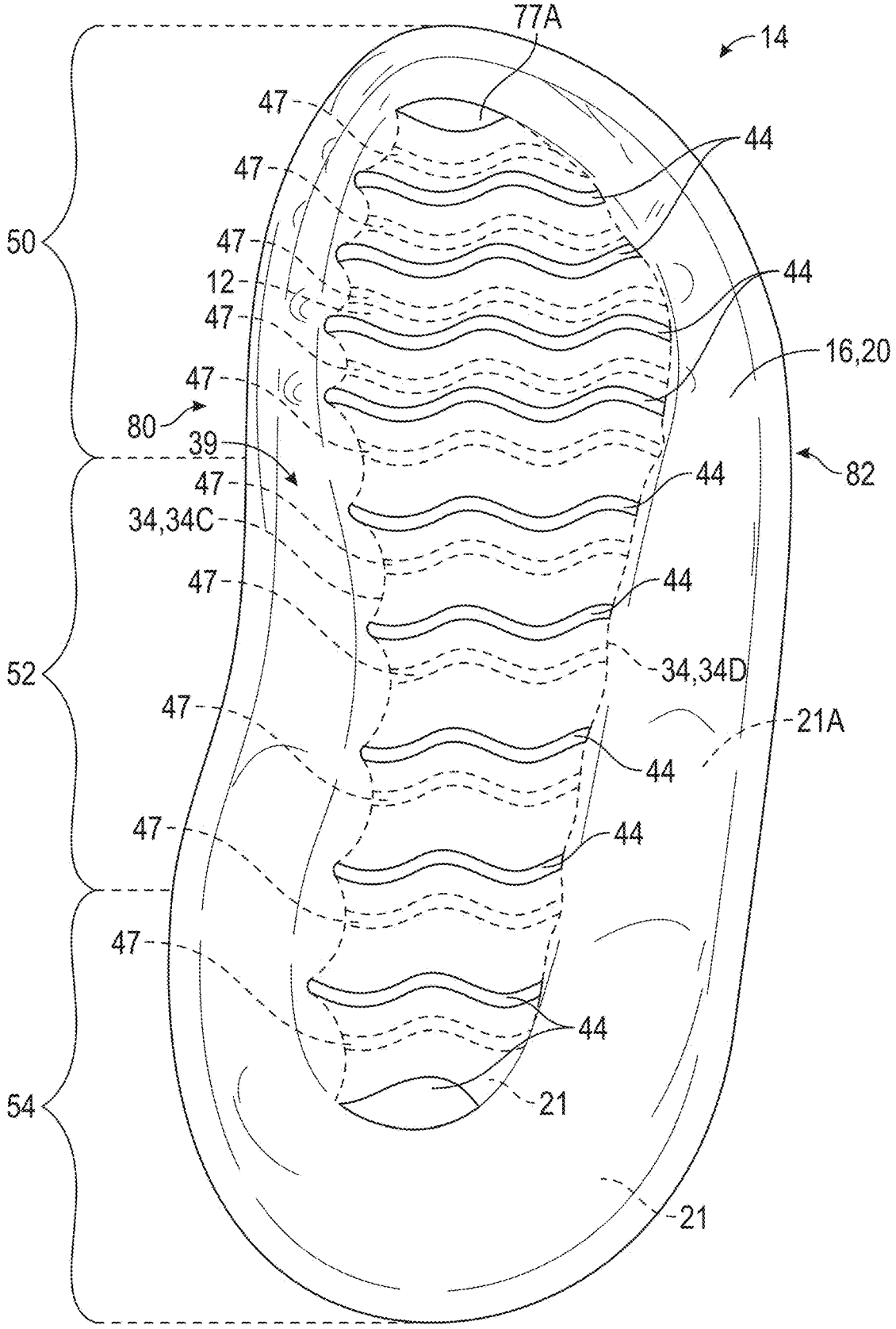
FIG. 8 is a plan view of the cushioning component of FIGS. 6-7 in an inflated state.
Figure 9:
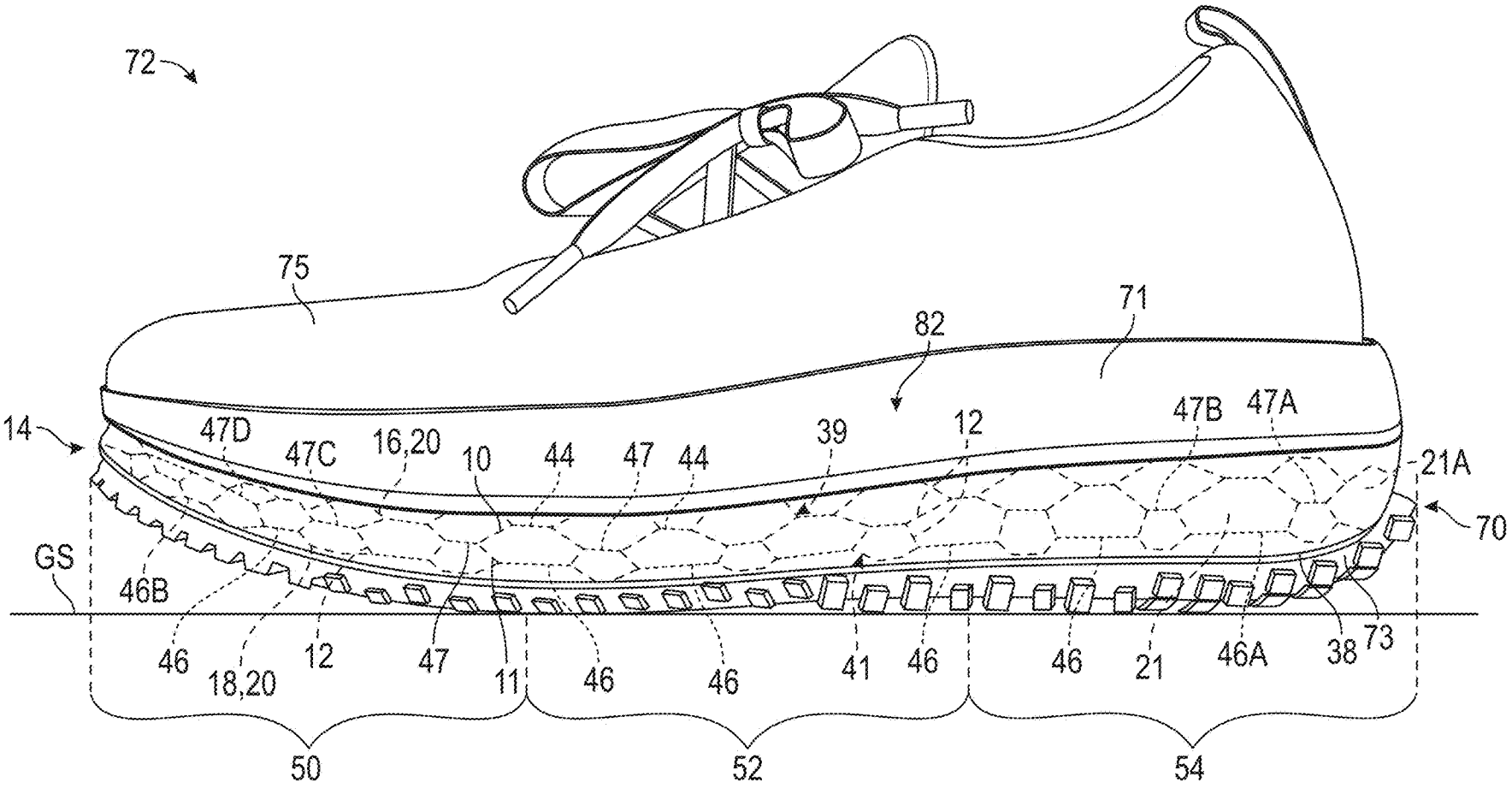
FIG. 9 is a medial side view of an article of footwear including the cushioning component of FIG. 8.

FIG. 9 shows that the tension created in the bonded polymeric sheets 10, 11 of the core 12 by the inflation of the interior cavity 21 causes portions of the first barrier sheet 16 inward of the outer perimeter 34 of the core 12 to be pulled downward at the bonds 44, as also indicated by the contoured exterior surface 39 of the first barrier sheet 16 in FIG. 8. Because the outer perimeter 34 of the core 12 is entirely inward of the peripheral bond 38, the barrier sheets 16, 18 will not be tethered together at a peripheral portion 21A of the interior cavity 21 outward of the outer perimeter 34 of the core 12 and inward of the peripheral bond 38. The distance between the inner surfaces 17 and 19 and the resulting height of the cushioning component 14 may thus be greatest outward of the core 12. The top exterior surface 39 is only partly shown and is represented with hidden lines in FIG. 9 where the first barrier sheet 16 is pulled downward by the first polymeric sheet 10 at the bonds 44.

Similarly, tension created in the bonded polymeric sheets 10, 11 of the core 12 by the inflation of the interior cavity 21 causes portions of the second barrier sheet 18 inward of the outer perimeter 34 of the core 12 to be pulled upward at the bonds 46, as indicated by the contoured exterior surface 41 of the second barrier sheet 18 in FIG. 9. The pattern of anti-weld material 24 disposed on the polymeric sheets 10 and 11 the resulting patterns of bonds 44, 46 of the polymeric sheets 10 and 11, respectively, of the core 12 to the barrier sheets 16, 18 can be selected to control the resulting contours of the exterior surfaces 39, 41 of the barrier sheets 16, 18.

FIG. 9 shows the sole structure 70 also includes another midsole layer 71, such as a foam midsole layer, which is secured to and overlies the cushioning component 14 (e.g., secured to the first barrier sheet 16). The sole structure 70 also includes an outsole 73 secured to the bottom of the cushioning component 14 (e.g., to the second barrier sheet 18). A footwear upper 75 is secured to the sole structure 70 to support a foot over the cushioning component 14. The sole structure 70 is a non-limiting example, and the cushioning component 14 may be used in a sole structure with a different configuration than in FIG. 9.

Additionally, FIGS. 6, 7, and 9 best show that the bonds 47 of the third set are offset from the bonds 46 of the second set and from the bonds 44 of the first set, and each bond 46 of the second set is wider than adjacent bonds 47 of the third set. Furthermore, in an example, each bond 47 of the third set is not narrower than adjacent bonds 44 of the first set.

As shown in FIG. 9, some or all of the wavy bonds 46 of the second set progressively decrease in width from the heel region 54 to the forefoot region 50 of the article of footwear 72. For example, the bonds 46 generally decrease in width from a bond 46A in the heel region 54 to a bond 46B in the forefoot region 50 in FIG. 9. In some implementations, the bond 44 may also similarly decrease in width from the heel region 54 to the forefoot region 50.

Moreover, the bonds 44 are spaced closer to one another in the forefoot region 50 than in the heel region 54, and the bonds 46 are spaced closer to one another in the forefoot region 50 than in the heel region 54. This may also be illustrated by the bonds 46 of the second set of bonds and the bonds 47 of the third set of bonds. For example, the plurality of wavy bonds includes a first group of bonds (e.g., adjacent bonds 47C and 47D) in the forefoot region 50 and a second group of bonds (e.g., adjacent bonds 47A and 47B) in the heel region 54. Spacing between the adjacent bonds 47C and 47D of the first group of bonds is less than spacing between the adjacent bonds 47A and 47B of the second group of bonds such that the opposing inner surfaces 17, 19 of the barrier sheets 16, 18 are held closer to one another in the forefoot region 50 than in the heel region 54. This configuration also results in toe spring, which is the gradual increasing elevation of the second barrier sheet 18 away from the ground surface GS in the forefoot region 50 in a forward direction when in a steady state position (e.g., unloaded or at least not under a dynamic compressive load) as shown in FIG. 9. This pre-shaping of the cushioning component 14 with a toe spring via the bond placement helps to create a forward foot roll and easier toe-off during a forward motion of the wearer.

Referring to FIGS. 6-8, in addition to bond placement to promote toe spring, the outer perimeter 34 of the core 12 is spaced further inward of the peripheral bond 38 in the heel region 54 than in the forefoot region 50. This is best shown in FIG. 7 where a distance D1 from the outer perimeter 34 of the core 12 to the peripheral bond 38 in the heel region 54 is greater than a distance D2 from the outer perimeter 34 of the core 12 to the peripheral bond 38 in the forefoot region 50. This creates a larger and taller peripheral portion of the interior cavity 21 around the core 12 in the heel region 54 than in the forefoot region 50, as best shown in FIG. 9, which causes the cushioning component 14 to nest around the heel where the bonds 44 on the first barrier sheet 16 tend to pull the barrier sheet 16 down inward of peripheral portion 21A of the interior cavity 21 that is disposed outward of the core 12. Stated differently, as best shown in FIG. 8, the first barrier sheet 16 may recess slightly downward between the medial side 80 and the lateral side 82 above the core 12 in the heel region 54, helping to cup the heel.

The following Clauses provide example configurations of an article of footwear having a cushioning component as disclosed herein.

Clause 1. An article of footwear comprising: a sole structure having a cushioning component, the cushioning component including: a bladder including a first barrier sheet and a second barrier sheet, the first barrier sheet and the second barrier sheet together defining an interior cavity between opposing inner surfaces of the first barrier sheet and the second barrier sheet, and the first barrier sheet and the second barrier sheet sealed to one another along a peripheral bond to enclose the interior cavity and retain a gas in the interior cavity; and a core disposed in the interior cavity and spaced entirely inward of the peripheral bond, the core including at least one polymeric sheet traversing the interior cavity between and directly bonded to the opposing inner surfaces of the first barrier sheet and the second barrier sheet at a plurality of wavy bonds to tether the first barrier sheet to the second barrier sheet, the at least one polymeric sheet displaced from the opposing inner surfaces by the gas at unbonded areas of the at least one polymeric sheet, the plurality of wavy bonds arranged with waves having peaks and valleys extending in a fore-aft direction of the article of footwear and such that the gas in the interior cavity is in fluid communication around the at least one polymeric sheet without the at least one polymeric sheet creating any sealed chambers within the bladder that are not in fluid communication with the interior cavity.

Clause 2. The article of footwear of clause 1, wherein anti-weld material is disposed on the core at the unbonded areas.

Clause 3. The article of footwear of any of clauses 1-2, wherein the core lays flat within the bladder with the unbonded areas contacting the opposing inner surfaces when the interior cavity of the bladder is uninflated.

Clause 4. The article of footwear of any of clauses 1-2, wherein a thickness of each polymeric sheet of the at least one polymeric sheet of the core is not greater than a thickness of the first barrier sheet and is not greater than a thickness of the second barrier sheet.

Clause 5. The article of footwear of any of clauses 1-2, wherein: the plurality of wavy bonds includes a first group of bonds in a forefoot region of the article of footwear and a second group of bonds in a heel region of the article of footwear; and spacing between adjacent bonds of the first group of bonds is less than spacing between adjacent bonds of the second group of bonds such that the opposing inner surfaces are held closer to one another by the at least one polymeric sheet in the forefoot region than in the heel region.

Clause 6. The cushioning component of any of clauses 1-2, wherein an outer perimeter of the at least one polymeric sheet is spaced further inward of the peripheral bond in a heel region of the article of footwear than in a forefoot region of the article of footwear.

Clause 7. The article of footwear of any of clauses 1-2, wherein: the opposing inner surfaces of the bladder include a first inner surface of the first barrier sheet and a second inner surface of the second barrier sheet; the at least one polymeric sheet of the core includes a first polymeric sheet and a second polymeric sheet, the first polymeric sheet disposed between the first barrier sheet and the second polymeric sheet, and the second polymeric sheet disposed between the first polymeric sheet and the second barrier sheet such that a first side of the first polymeric sheet faces the first inner surface of the first barrier sheet, a second side of the first polymeric sheet faces a first side of the second polymeric sheet, and a second side of the second polymeric sheet faces the second inner surface of the second barrier sheet; and the first side of the first polymeric sheet is directly bonded to the first inner surface of the first barrier sheet at a first set of bonds of the plurality of wavy bonds, the second side of the second polymeric sheet is directly bonded to the second inner surface of the second barrier sheet at a second set of bonds of the plurality of wavy bonds, the second side of the first polymeric sheet is directly bonded to the first side of the second polymeric sheet at a third set of bonds of the plurality of wavy bonds, the bonds of the third set alternating with the bonds of the first set along a length of the first polymeric sheet, and the bonds of the third set alternating with the bonds of the second set along a length of the second polymeric sheet.

Clause 8. The article of footwear of clause 7, wherein at least some of the bonds of the second set are aligned with the at least some of the bonds of the first set in a fore-aft direction of the article of footwear when the interior cavity of the bladder is uninflated.

Clause 9. The article of footwear of clause 8, wherein at least some of the bonds of the second set are wider in the fore-aft direction than the bonds of the first set with which the at least some of the bonds of the second set are aligned.

Clause 10. The article of footwear of clause 9, wherein the at least some of the bonds of the second set are in a forefoot region of the article of footwear.

Clause 11. The article of footwear of clause 9, wherein the at least some of the bonds of the second set are in a heel region of the article of footwear.

Clause 12. The article of footwear of clause 9, wherein: all of the bonds of the second set are aligned with the bonds of the first set; and each bond of the second set is wider than the respective bond of the first set with which the bond of the second set is aligned.

Clause 13. The article of footwear of clause 9, wherein: the bonds of the third set are offset in the fore-aft direction from the bonds of the second set and from the bonds of the first set; and wherein each bond of the second set is wider in the fore-aft direction than adjacent bonds of the third set.

Clause 14. The article of footwear of clause 13, wherein each bond of the third set has a width greater than or equal to a width of adjacent bonds of the first set.

Clause 15. The article of footwear of any of clauses 1-2, wherein each bond of the plurality of wavy bonds extends continuously from a medial edge of the core to a lateral edge of the core.

Clause 16. An article of footwear comprising: a sole structure having a cushioning component, the cushioning component including: a bladder including a first barrier sheet having a first inner surface and a second barrier sheet having a second inner surface opposing the first inner surface; wherein the second barrier sheet is disposed distally of the first barrier sheet, the first barrier sheet and the second barrier sheet define an interior cavity between the first inner surface and the second inner surface, and the first barrier sheet and the second barrier sheet are sealed to one another along a peripheral bond to enclose the interior cavity and retain a gas in the interior cavity; and a core disposed in the interior cavity and spaced entirely inward of the peripheral bond, the core including at least one polymeric sheet traversing the interior cavity between and directly bonded to the first inner surface at a first set of bonds and to the second inner surface at a second set of bonds to tether the first barrier sheet to the second barrier sheet; wherein at least some of the bonds of the second set are wider in a fore-aft direction of the article of footwear than at least some of the bonds of the first set; wherein the at least one polymeric sheet is displaced from the first inner surface and the second inner surface by the gas at unbonded areas of the at least one polymeric sheet; and wherein the first set of bonds and the second set of bonds are arranged such that the gas in the interior cavity is in fluid communication around the at least one polymeric sheet without the at least one polymeric sheet creating any sealed chambers within the bladder that are not in fluid communication with the interior cavity.

Clause 17. The article of footwear of clause 16, wherein the at least some of the bonds of the second set are in a forefoot region of the article of footwear.

Clause 18. The article of footwear of clause 16, wherein the at least some of the bonds of the second set are in a heel region of the article of footwear.

Clause 19. The article of footwear of any of clauses 16-18, wherein the bonds of the second set progressively decrease in width from a heel region to a forefoot region of the article of footwear.

Clause 20. The article of footwear of any of clauses 16-18, wherein: the at least one polymeric sheet of the core includes a first polymeric sheet and a second polymeric sheet, the first polymeric sheet disposed between the first barrier sheet and the second polymeric sheet, and the second polymeric sheet disposed between the first polymeric sheet and the second barrier sheet such that a first side of the first polymeric sheet faces the first inner surface of the first barrier sheet, a second side of the first polymeric sheet faces a first side of the second polymeric sheet, and a second side of the second polymeric sheet faces the second inner surface of the second barrier sheet; and the first side of the first polymeric sheet is directly bonded to the first inner surface of the first barrier sheet by the first set of bonds, the second side of the second polymeric sheet is directly bonded to the second inner surface of the second barrier sheet by the second set of bonds, the second side of the first polymeric sheet is directly bonded to the first side of the second polymeric sheet by a third set of bonds, the bonds of the third set alternating with the bonds of the first set along a length of the first polymeric sheet, and the bonds of the third set alternating with the bonds of the second set along a length of the second polymeric sheet.

Clause 21. The article of footwear of clause 20, wherein the at least some of the bonds of the second set that are wider than the at least some of the bonds of the first set are aligned with the at least some of the bonds of the first set in the fore-aft direction when the interior cavity of the bladder is uninflated.

Clause 22. The article of footwear of clause 21, wherein the at least some of the bonds of the second set are in a forefoot region of the article of footwear.

Clause 23. The article of footwear of clause 21, wherein the at least some of the bonds of the second set are in a heel region of the article of footwear.

Clause 24. The article of footwear of clause 21, wherein: all of the bonds of the second set are aligned with the bonds of the first set of bonds; and each bond of the second set of bonds is wider than the respective bond of the first set with which the bond of the second set is aligned.

Clause 25. The article of footwear of clause 21, wherein: the bonds of the third set are offset in the fore-aft direction from the bonds of the second set and from the bonds of the first set; and wherein each bond of the second set is wider in the fore-aft direction than adjacent bonds of the third set.

Clause 26. The article of footwear of clause 25, wherein each bond of the third set has a width greater than or equal to a width of adjacent bonds of the first set.

Clause 27. The article of footwear of any of clauses 16-18, wherein each bond of the first set and each bond of the second set extends continuously from a medial edge of the core to a lateral edge of the core.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready-to-wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" particularly refers to a direction extending a length of a component. For example, a longitudinal direction of a shoe extends between a forefoot region and a heel region of the shoe. The term "forward" or "anterior" is used to particularly refer to the general direction from a heel region toward a forefoot region, and the term "rearward" or "posterior" is used to particularly refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" particularly refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" particularly refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" particularly refers to the vertical direction pointing towards a top of the component, which may include an instep, a fastening region and/or a throat of an upper. The term "downward" or "downwards" particularly refers to the vertical direction pointing opposite the upwards direction, toward the bottom of a component and may generally point towards the bottom of a sole structure of an article of footwear.

The "interior" of an article of footwear, such as a shoe, particularly refers to portions at the space that is occupied by a wearer's foot when the shoe is worn. The "inner side" of a component particularly refers to the side or surface of the component that is (or will be) oriented toward the interior of the component or article of footwear in an assembled article of footwear. The "outer side" or "exterior" of a component particularly refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" particularly refer to the direction toward the interior of the component or article of footwear, such as a shoe, and the terms "outward" and "outwardly" particularly refer to the direction toward the exterior of the component or article of footwear, such as the shoe. In addition, the term "proximal" particularly refers to a direction that is nearer a center of a footwear component, or is closer toward a foot when the foot is inserted in the article of footwear as it is worn by a user. Likewise, the term "distal" particularly refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting, and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. An article of footwear comprising:

a sole structure having a cushioning component, the cushioning component including:

a bladder including a first barrier sheet and a second barrier sheet, the first barrier sheet and the second barrier sheet together defining an interior cavity between opposing inner surfaces of the first barrier sheet and the second barrier sheet, and the first barrier sheet and the second barrier sheet sealed to one another along a peripheral bond to enclose the interior cavity and retain a gas in the interior cavity; and a core disposed in the interior cavity and spaced entirely inward of the peripheral bond, the core including at least one polymeric sheet traversing the interior cavity between and directly bonded to the opposing inner surfaces of the first barrier sheet and the second barrier sheet at a plurality of wavy bonds to tether the first barrier sheet to the second barrier sheet, the at least one polymeric sheet displaced from the opposing inner surfaces by the gas at unbonded areas of the at least one polymeric sheet, the plurality of wavy bonds arranged with waves having peaks and valleys extending in a fore-aft direction of the article of footwear and such that the gas in the interior cavity is in fluid communication around the at least one polymeric sheet without the at least one polymeric sheet creating any sealed chambers within the bladder that are not in fluid communication with the interior cavity;

wherein the opposing inner surfaces of the bladder include a first inner surface of the first barrier sheet and a second inner surface of the second barrier sheet;

wherein each wavy bond of the plurality of wavy bonds tethering the at least one polymeric sheet to the first inner surface of the first barrier sheet extends continuously from a medial edge of the core to a lateral edge of the core;

wherein adjacent ones of the wavy bonds tethering the at least one polymeric sheet to the first inner surface of the first barrier sheet are spaced apart from and nonintersecting with one another; and wherein the cushioning component is characterized by an absence of any bonds bonding the at least one polymeric sheet to the first inner surface of the first barrier sheet between the adjacent ones of the wavy bonds.

2. The article of footwear of claim 1, wherein anti-weld ink is disposed on the core at the unbonded areas.

3. The article of footwear of claim 1, wherein the core lays flat within the bladder with the unbonded areas contacting the opposing inner surfaces when the interior cavity of the bladder is uninflated.

4. The article of footwear of claim 1, wherein a thickness of each polymeric sheet of the at least one polymeric sheet of the core is less than or equal to a thickness of the first barrier sheet and is less than or equal to than a thickness of the second barrier sheet.

5. The article of footwear of claim 1, wherein:

the plurality of wavy bonds includes a first group of bonds in a forefoot region of the article of footwear and a second group of bonds in a heel region of the article of footwear; and spacing between adjacent bonds of the first group of bonds is less than spacing between adjacent bonds of the second group of bonds such that the opposing inner surfaces are held closer to one another by the at least one polymeric sheet in the forefoot region than in the heel region.

6. The cushioning component of claim 1, wherein a distance in a transverse direction of the cushioning component from an outer perimeter of the at least one polymeric sheet to the peripheral bond is greater in a heel region of the article of footwear than in a forefoot region of the article of footwear.

7. The article of footwear of claim 1, wherein:

the at least one polymeric sheet of the core includes a first polymeric sheet and a second polymeric sheet, the first polymeric sheet disposed between the first barrier sheet and the second polymeric sheet, and the second polymeric sheet disposed between the first polymeric sheet and the second barrier sheet such that a first side of the first polymeric sheet faces the first inner surface of the first barrier sheet, a second side of the first polymeric sheet faces a first side of the second polymeric sheet, and a second side of the second polymeric sheet faces the second inner surface of the second barrier sheet; and the first side of the first polymeric sheet is directly bonded to the first inner surface of the first barrier sheet at a first set of bonds of the plurality of wavy bonds, the second side of the second polymeric sheet is directly bonded to the second inner surface of the second barrier sheet at a second set of bonds of the plurality of wavy bonds, the second side of the first polymeric sheet is directly bonded to the first side of the second polymeric sheet at a third set of bonds of the plurality of wavy bonds, the bonds of the third set alternating with the bonds of the first set along a length of the first polymeric sheet, and the bonds of the third set alternating with the bonds of the second set along a length of the second polymeric sheet.

8. The article of footwear of claim 7, wherein at least some of the bonds of the second set are aligned with the at least some of the bonds of the first set in a fore-aft direction of the article of footwear when the interior cavity of the bladder is in an uninflated state.

9. The article of footwear of claim 8, wherein at least some of the bonds of the second set are wider in the fore-aft direction than the bonds of the first set with which the at least some of the bonds of the second set are aligned.

10. The article of footwear of claim 9, wherein:

the bonds of the third set are offset in the fore-aft direction from the bonds of the second set and from the bonds of the first set; and wherein each bond of the second set is wider in the fore-aft direction than adjacent bonds of the third set.

11. The article of footwear of claim 10, wherein each bond of the third set has a width greater than or equal to a width of adjacent bonds of the first set.

12. An article of footwear comprising:

a sole structure having a cushioning component, the cushioning component including:

a bladder including a first barrier sheet having a first inner surface and a second barrier sheet having a second inner surface opposing the first inner surface;

wherein the second barrier sheet is disposed distally of the first barrier sheet, the first barrier sheet and the second barrier sheet define an interior cavity between the first inner surface and the second inner surface, and the first barrier sheet and the second barrier sheet are sealed to one another along a peripheral bond to enclose the interior cavity and retain a gas in the interior cavity; and a core disposed in the interior cavity and spaced entirely inward of the peripheral bond, the core including at least one polymeric sheet traversing the interior cavity between and directly bonded to the first inner surface at a first set of bonds and to the second inner surface at a second set of bonds to tether the first barrier sheet to the second barrier sheet;

wherein at least some of the bonds of the second set are wider in a fore-aft direction of the article of footwear than at least some of the bonds of the first set;

wherein the at least one polymeric sheet is displaced from the first inner surface and the second inner surface by the gas at unbonded areas of the at least one polymeric sheet;

wherein the first set of bonds and the second set of bonds are arranged such that the gas in the interior cavity is in fluid communication around the at least one polymeric sheet without the at least one polymeric sheet creating any sealed chambers within the bladder that are not in fluid communication with the interior cavity;

wherein the at least one polymeric sheet of the core includes a first polymeric sheet and a second polymeric sheet, the first polymeric sheet disposed between the first barrier sheet and the second polymeric sheet, and the second polymeric sheet disposed between the first polymeric sheet and the second barrier sheet such that a first side of the first polymeric sheet faces the first inner surface of the first barrier sheet, a second side of the first polymeric sheet faces a first side of the second polymeric sheet, and a second side of the second polymeric sheet faces the second inner surface of the second barrier sheet;

wherein the first side of the first polymeric sheet is directly bonded to the first inner surface of the first barrier sheet by the first set of bonds, the second side of the second polymeric sheet is directly bonded to the second inner surface of the second barrier sheet by the second set of bonds, the second side of the first polymeric sheet is directly bonded to the first side of the second polymeric sheet by a third set of bonds, the bonds of the third set alternating with the bonds of the first set along a length of the first polymeric sheet, and the bonds of the third set alternating with the bonds of the second set along a length of the second polymeric sheet; and wherein the at least some of the bonds of the second set that are wider than the at least some of the bonds of the first set are aligned with the at least some of the bonds of the first set in the fore-aft direction when the interior cavity of the bladder is in an uninflated state.

13. The article of footwear of claim 12, wherein the bonds of the second set progressively decrease in width from a heel region to a forefoot region of the article of footwear.

14. The article of footwear of claim 12, wherein the at least some of the bonds of the second set are in a forefoot region of the article of footwear.

15. The article of footwear of claim 12, wherein:

the bonds of the third set are offset in the fore-aft direction from the bonds of the second set and from the bonds of the first set; and wherein each bond of the second set is wider in the fore-aft direction than adjacent bonds of the third set.

16. The article of footwear of claim 15, wherein each bond of the third set has a width greater than or equal to a width of adjacent bonds of the first set.

17. The article of footwear of claim 12, wherein each bond of the first set and each bond of the second set extends continuously from a medial edge of the core to a lateral edge of the core.

* * * * *